US008237094B2

(12) United States Patent
Menassa

(10) Patent No.: US 8,237,094 B2
(45) Date of Patent: Aug. 7, 2012

(54) PULSE MODULATION HEATING SYSTEM AND METHOD

(76) Inventor: Cherif Menassa, Kirkland (CA)

( * ) Notice: Subject to any disclaimer, the term of this patent is extended or adjusted under 35 U.S.C. 154(b) by 440 days.

(21) Appl. No.: 12/654,464

(22) Filed: Dec. 22, 2009

(65) Prior Publication Data

US 2010/0155388 A1 Jun. 24, 2010

Related U.S. Application Data

(60) Provisional application No. 61/193,750, filed on Dec. 22, 2008.

(51) Int. Cl.
*H05B 1/02* (2006.01)

(52) U.S. Cl. ..... 219/491; 219/483; 219/494; 219/508; 236/78 R

(58) Field of Classification Search ..... 219/491, 219/482, 484, 485, 507, 519; 236/78 R, 236/78 A, 78 B
See application file for complete search history.

(56) References Cited

U.S. PATENT DOCUMENTS 4,355,760 A * 10/1982 Ruby ..... 236/47
4,446,359 A * 5/1984 Arribas et al. ..... 219/485
5,120,936 A * 6/1992 Shyu et al. ..... 219/497
5,658,480 A * 8/1997 Tennant et al. ..... 219/519
6,169,850 B1 1/2001 Menassa
6,420,685 B1 * 7/2002 Tanamachi ..... 219/501
6,894,254 B2 * 5/2005 Hauschulz ..... 219/506

* cited by examiner

*Primary Examiner* — Tan T. Nguyen

(74) *Attorney, Agent, or Firm* — Equinox Protection Inc.; Franz Bonsang, Patent Agent

(57) ABSTRACT

A pulse modulating heating system provides connection to a step heating system having a main heating controller configured for connection to a heat sensor and step heating relays connected to respective step heating element and for activating, during a heating cycle, a required quantity of mechanical relays and step heating elements to generate a required amount of heat. The pulse modulating heating system has inputs, one for each step heating relay, connectable to the main heating controller for detecting the relays activated during the cycle, i.e. the required quantity of relays. The pulse modulating system, based on the required quantity of step relays detected, activates a pulse heating element for a quantity of pulses relative to a maximum quantity of pulses for the cycle that is proportional to the required quantity of step relays relative the total number of step heating relays to generate the required amount of heat.

17 Claims, 6 Drawing Sheets

PULSE MODULATION HEATING SYSTEM AND METHOD

CROSS REFERENCE TO RELATED APPLICATIONS

This patent application claims benefit of U.S. Provisional Application for Patent Ser. No. 61/193,750 filed on Dec. 22, 2008, which is incorporated herein by reference.

FIELD OF THE INVENTION

The present invention concerns building heating systems and methods and is more particularly directed to a pulse modulation heating system for buildings and method therefor.

BACKGROUND OF THE INVENTION

Heating systems for buildings are well known in the art. Traditionally, such systems have consisted of step heating systems. For step heating systems, a plurality of step heating elements, for example heating coils, are installed in series, generally in an air circulation duct or other means of directing air flow. Typically, a sufficient total quantity N of heating coils is installed to meet the heating needs of a discrete heated space, for example 1 or more rooms, of a building. Each step heating element is connected to a corresponding step heating mechanical relay which closes and opens to, respectively, enable and disable a circuit providing power to the heating element to activate and deactivate the circuit. Typically, there is one corresponding mechanical relay for each step heating element. Thus, for a total quantity N of step heating elements, there is an equal total quantity N mechanical relays. All of the mechanical relays are connected, directly or indirectly, to a step heating controller which provides signals thereto to activate and deactivate the relays based on input received from a sensor, for example a heat sensor, thermometer, or air flow sensor disposed in the heated space or air flow duct connecting thereto. The relays, and therefore step heating elements, are sequentially activated and deactivated in predefined ascending and descending sequence or series, i.e. such that a heating element and second corresponding relay connected thereto are not activated until a first eating element and corresponding relay connected thereto are activated. Similarly, a third heating element and corresponding relay and are not activated until the first and second corresponding relays and heating elements are activated. In the same fashion, a second heating element and corresponding relay connected thereto is not deactivated unless the third heating element and corresponding relay is already deactivated. Thus, for total quantity N heaters (or steps), the heaters are switched on as required based on the heat detected by the sensor, in sequential order, providing increasing proportional heating, until a desired level of temperature is detected by the heat sensor, as follows: 0/N, 1/N, 2/N, . . . R/N, where R is less than or equal to N and represents a required quantity of heating elements to generate a required amount of heat to achieve the desired level of temperature, with R=N corresponding to all step heating elements being activated and the maximum amount of heating being provided. The relays and step heaters are deactivated by the step heating controller in exactly the reverse order. Each sensor and controller may also connected to a main heating controller responsible for controlling the heating for many heated spaces, for example rooms, hallways, or the like within a building. Typically, it is the main heating controller and/or the controller which determines the quantity of heating elements to activate and deactivate as described above.

Unfortunately, such traditional step heating systems are quite costly in that they require, for each step heating element, an accompanying mechanical relay. Further, such step heating systems can be quite unreliable, since if a mechanical relay fails, then the heating element connected thereto will also become unavailable. Further, the lifetime of the mechanical relays, due to the mechanical nature thereof, is relatively short, typically about 0.1 megacycles of switching or 100,000 cycles of activation or deactivation. Thus, both inconveniently and expensively, the relays have to be replaced relatively often.

More recently, to circumvent the aforementioned disadvantages associated with step heating systems, pulse modulation heating systems were developed. For such systems, there are H, typically one, pulse heating elements per heated space, again placed in the path of air flow such as an adjoining air circulation duct or system. The maximum heating capacity of the H pulse heating elements for the pulse modulation system is approximately equal, over a predefined heating cycle C, to that which would be provided by the quantity of N step heating elements, when all N step heating elements are activated, in a step heating system for the same heated space over the duration of the heating cycle C. The heating cycle C may be defined in terms of a maximum number of electronic pulses MP for a predefined period of time T, for example 120 pulses over one or more units of time, or simply as a predefined period of time T in conventional units of time, such as seconds or minutes. Once again, a heat sensor for the heated space detects the temperature therein and is connected to a pulse heating controller connected to the H pulse heating elements and which activates and deactivates the pulse heating elements. The pulse heating controller and sensor may also, as in a step heating system, be connected to a main heating controller.

Instead of using mechanical relays for sequentially turning on and off the pulse heating elements, the pulse heating controller of the pulse modulation system has a solid state relay, connected directly to all of the H pulse heating elements. The pulse heating controller activates the H pulse heating elements by sending signals thereto through the solid state relay as, or during, a quantity P of electronic pulses emitted during the time period T of heating cycle C, with the quantity of pulses PP sent being equal to or less than the predefined maximum quantity of pulses MP defined for the time period T of the heating cycle. Thus, based on the input from the heat sensor, the pulse heating controller activates the solid state relay and pulse heating element connected thereto, for a variable quantity PP of pulses, out of the maximum quantity MP possible, for the period of time T of the heating cycle C, based on the amount of heating required. Thus, if more heating is required, the variable quantity P of pulses is increased, wherein if less or no heating is required, the variable quantity PP is reduced. Typically, zero-crossing switches or relays are used for the pulse modulation system, with the solid state relay being actuable (ON) and deactuable (OFF) for activating and deactivating the relay and pulse heating element at about 0 volts AC crossing of the AC signal, the AC signal preferably being about 60 Hz.

Advantageously, compared to heat stepping systems, the pulse modulation systems can be implemented with only one pulse heating element per discrete heating space of each building, which reduces material, maintenance, and installation costs, as well as installation and maintenance time. Further, for pulse modulation heating systems, there is typically only one solid state relay per heated space, which further reduces costs. Additionally, the solid state relay, which has a lifespan between 10 and 100 million cycles, is far more durable than mechanical relays used by step heating systems, further reducing maintenance costs.

Given the above advantages of pulse modulation systems compared to step heating systems, replacement of step heating systems with pulse modulation heating systems is highly desirable. However, since the step heating controllers and main heating controller controllers, common in many older buildings, for step heating systems are configured to sequentially activate and deactivate a plurality of mechanical relays and pulse heating elements, based on heating needs, as opposed to activating a single solid state relay for a fixed portion of time or pulses, i.e. P, of a total heating cycle interval of time or pulses, i.e. T, replacement of a step heating system may require, even for a single heated space, replacement of the main system for an entire building, not to mention the relays and step heating controllers.

Accordingly, there is a need for an improved pulse modulation heating system and method.

SUMMARY OF THE INVENTION

It is therefore a general object of the present invention to provide an improved pulse modulation heating system and method.

An advantage of the present invention is that the improved pulse modulation heating system and method allows for connection of a pulse modulation heating system to a main heating controller designed for use with a step heating system.

Another advantage of the present invention is that the pulse modulation heating system and method allows for interconnection of pulse heating systems and pulse modulation heating systems for different heated areas in a single building.

Yet another advantage of the pulse modulation heating system and method is that the step heating system for each heated space may be upgraded one by one to a corresponding pulse modulation heating system, thus allowing for gradual upgrading and retrofitting as required, especially in conjunction with the air heating device described in the applicant's U.S. Pat. No. 6,169,850.

A further advantage of the present invention is that the pulse modulation heating system and method provides pulse heating modulation that is more reliable and less costly than step heating systems.

According to a first aspect of the present invention, there is provided a pulse modulation heating system for connection to a main heating controller for an existing step heating system for a discrete space in a building, the step heating system having a heat sensor for detecting a level of heat in the space, a plurality of step heating elements, and a plurality of corresponding mechanical relays, one corresponding mechanical relay connected to each step heating element, the main heating controller being connected to the heat sensor and configured for connection to the corresponding mechanical relays for, based on the level of heat, providing to the corresponding mechanical relays in a predefined sequence respective signals for each corresponding relay for activating and deactivating the corresponding mechanical relays in the predefined sequence until a required quantity of the corresponding mechanical relays and the heating elements is activated to generate a required amount of heat, the system comprising:

a pulse heating element, the pulse heating element having a total pulse heating capacity when activated over a predefined heating cycle generally equal to a total step heating capacity of all of the step heating elements when activated over the predefined heating cycle; and a pulse heating controller connected to the pulse heating element and having inputs connectable to the main heating controller, one respective input of the inputs for each corresponding mechanical relay for receiving the respective signals instead of the corresponding mechanical relay and for activating the pulse heating element, based on the respective signals, for a pulse portion of the predefined heating cycle, the pulse portion corresponding generally proportionally to the required quantity of the respective inputs receiving the respective signals for activating the corresponding mechanical relays and connected pulse heating elements relative a total quantity of the respective inputs connected to the main heating controller, to generate a pulse amount of heat generally equal to the required amount of heat.

According to a second aspect of the present invention, there is provided a method for operating a pulse modulation heating system from a main heating controller for an existing step heating system for a discrete space in a building, the step heating system having a heat sensor for detecting a level of heat in the space, a plurality of step heating elements, and a plurality of corresponding mechanical relays, one corresponding mechanical relay connected to each step heating element, the main heating controller being connected to the heat sensor and configured for connection to the corresponding mechanical relays for, based on the level of heat, providing to the corresponding mechanical relays in a predefined sequence respective signals for each corresponding relay for activating and deactivating the corresponding mechanical relays in the predefined sequence until a required quantity of the corresponding mechanical relays and the heating elements is activated to generate a required amount of heat, the method comprising the steps of:

receiving the respective signals on respective inputs of a pulse heating controller, one the respective input receiving the respective signals for each corresponding mechanical relay; and activating a pulse heating element with the pulse heating controller, based on the respective signals received by the respective inputs, for a pulse portion of a predefined heating cycle, the pulse heating element having a total pulse heating capacity when activated over an predefined heating cycle generally equal to a total step heating capacity of all of the step heating elements when activated over the predefined heating cycle, the pulse portion of the predefined heating cycle corresponding generally proportionally to the required quantity of the respective inputs receiving the respective signals for activating the corresponding relays relative to a total quantity of the respective inputs connected to the main controller, the pulse heating element thereby generating a pulse amount of heat generally equal to the required amount of heat.

According to a third aspect of the present invention, there is provided a method for retrofitting connection of a pulse modulation heating system to a main heating controller for an existing step heating system for a discrete space in a building, the step heating system having a heat sensor for detecting a level of heat in the space, a plurality of step heating elements, and a plurality of corresponding mechanical relays, one corresponding mechanical relay connected to each step heating element, the main heating controller being connected to the heat sensor and configured for connection to the corresponding mechanical relays for, based on the level of heat, providing to the corresponding mechanical relays, in a predefined sequence, respective signals for each corresponding relay for activating and deactivating the corresponding mechanical relays in the predefined sequence until a required quantity of the corresponding mechanical relays and the heating elements is activated to generate a required amount of heat, the method comprising the steps of:

installing a pulse heating element for the heated space, the pulse heating element having a total pulse heating capacity when activated over an predefined heating cycle generally equal to a total step heating capacity of all of the step heating elements when activated over the predefined heating cycle;

installing a pulse heating controller and connecting the pulse heating controller to the pulse heating element; and connecting the main heating controller to inputs for the mechanical relays on the pulse heating controller, one respective input for each mechanical relay, for receiving the respective signals for the corresponding mechanical relay, wherein the pulse heating controller is configured for, based on the respective signals, activating the pulse heating controller for a pulse portion of the predefined heating cycle, the pulse portion corresponding generally proportionally to the required quantity of the respective inputs receiving the respective signals for activating the corresponding relays relative a total quantity of the respective inputs previously connected to the main controller, to generate a pulse amount of heat generally equal to the required amount of heat.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
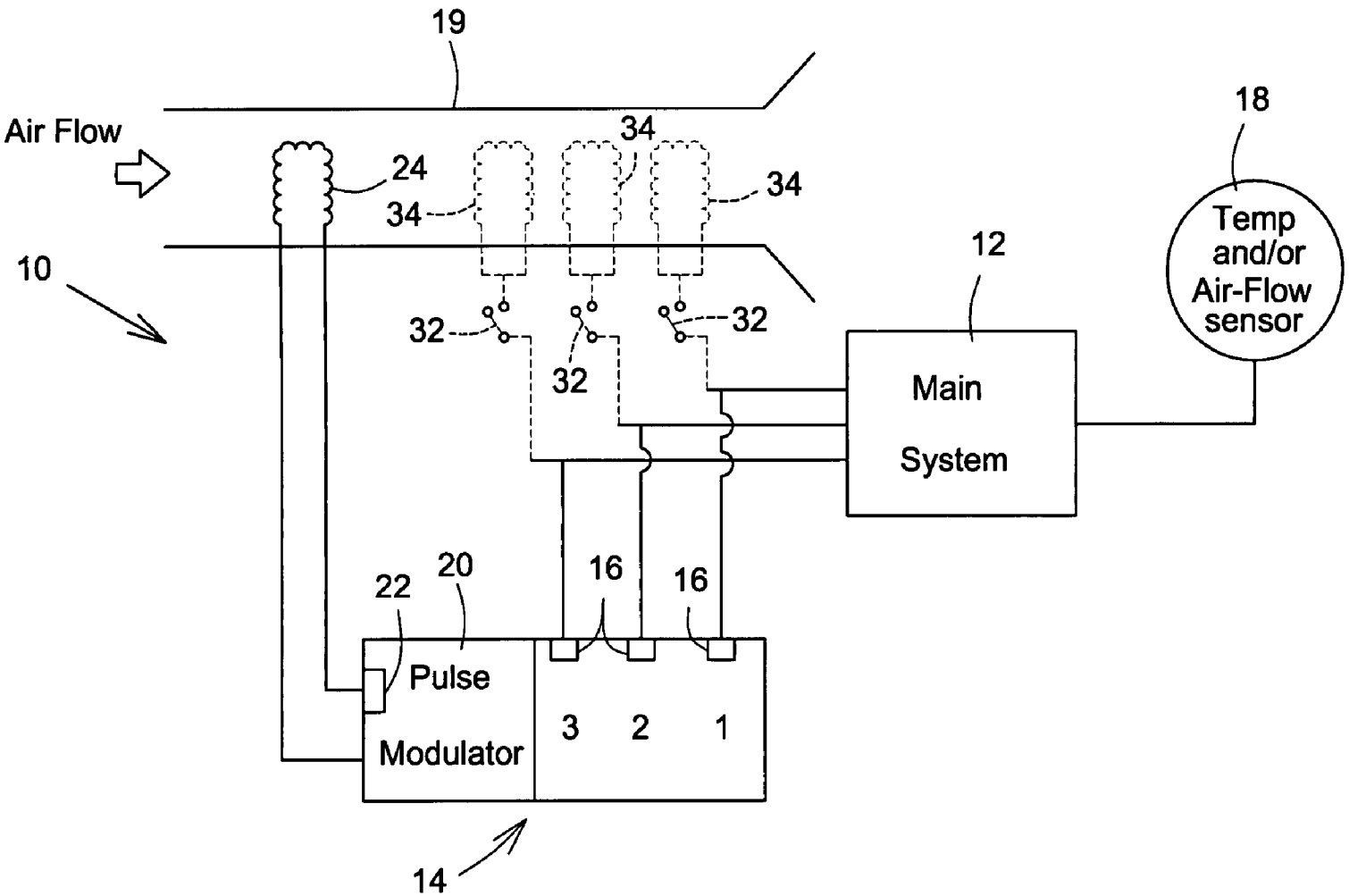
FIG. 1 is a schematic view of a pulse modulating system in accordance with an embodiment of the present invention.
Figure 2:
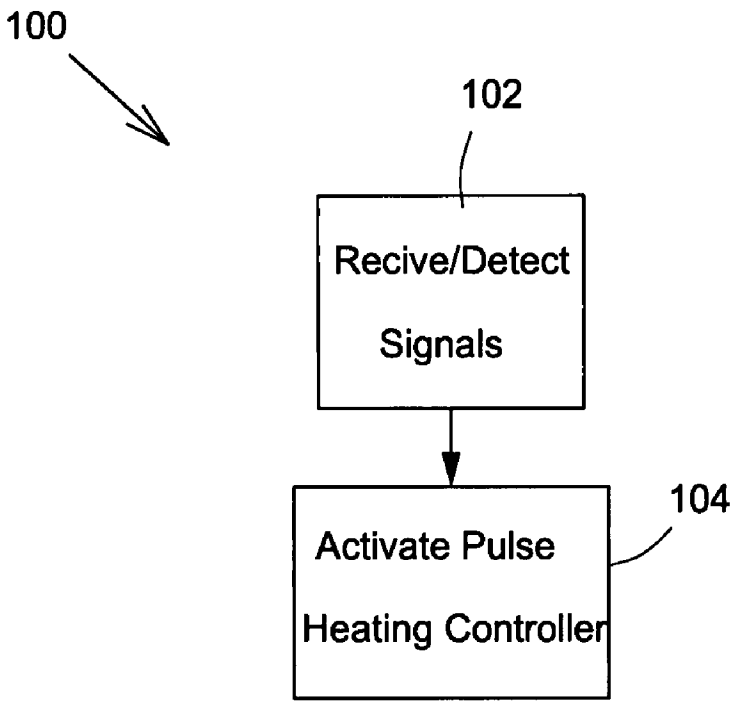
FIG. 2 is a flow chart showing a method for operating the pulse modulation system shown in FIG. 1 when connected to a main heating controller of a step heating system.

Reference is now made to FIGS. 1 and 2. As shown, the pulse heating modulation system, shown generally as 10, has a main heating controller 12, which may be designed to control either pulse modulation heating systems, step heating systems, or both. For purposes of illustration, however, the main heating controller 12 is, or is configured to operate with, a step heating controller 12. In fact, while the main heating controller 12 shown is generally intended to be a controller for an entire building, it should be noted that the main heating controller 12 could also be a step heating controller 12 for a single heated space.

The main heating controller 12 is connected to a pulse heating controller, shown generally as 14, by a series of step heating inputs 16. As shown, there is one respective step heating input 16 for each step heating mechanical relay 32 and step heating element 34, each respective step heating input corresponding to an input from a step heating controller or the main heating controller 12 for sequentially activating (closing) and deactivating (opening) a mechanical step heating relay 32, as described above for prior art step heating systems and shown in stippled lines. Accordingly, for a total quantity (N) of step heating elements, there is an equal maximum quantity N of inputs 16. The pulse heating controller 14 is connected, either directly or via the main system controller 12, to the temperature (heat) and/or air-flow sensors 18 disposed within the heating space or in an air circulation system, such as an air duct 19, proximal thereto, which senses the level, i.e. amount, of heat in the air in the discrete heated space.

The pulse heating controller 14 has pulse modulator 20 having at least one solid state relay 22. The solid state relay 22 is connected to a pulse heating quantity (H), preferably one, of pulse heating elements 24. There is one respective solid state relay 22 for each pulse heating element 24. The pulse heating quantity H of pulse heating elements 24 have a total pulse heating capacity over heating cycle (C) that is generally equal to the step heating capacity of all N step heating elements 34, when activated, for a step heating system, N being the total quantity of step heating elements 34 of a step heating system replaced by the pulse heating elements 24. The heating cycle C is measured as a maximum possible quantity MP of electrical pulses for a predefined period of time T, or simply as a predefined period of time T.

Reference is now made to FIG. 1 and to FIG. 2, which shows a method, shown generally as 100, for operating the pulse modulation heating system 10 from the main heating controller 12 for the step heating elements 34 and relays 32. As shown, the pulse heating controller 14, and more particularly the pulse modulator 20, receives, and thus detects, the respective signals for activating and deactivating each step heating relay 32, as shown at step 102. Based on the signals received, the step heating controller 14, at step 104 activates the solid state relay 22 and step heating element 24 for a pulse portion (PP) of pulses relative to the maximum pulses (MP) of the heating cycle that corresponds generally proportionally to the required quantity (R) of the respective inputs 16 receiving respective signals for activating the corresponding mechanical relays 32 relative to the total quantity N of the respective inputs connected to the main controller, the total quantity N being equal to the total quantity of step heating elements 34 and mechanical step heating relays 32. Thus, the pulse portion PP is a proportional quantity of pulses relative to the maximum quantity of pulses equal in proportion to the required quantity of inputs 16 receiving activation signal, and therefore the required quantity R of mechanical relays 32 and step heating elements 34, relative to the total quantity N of connected inputs 16, mechanical relays 32, and step heating elements 34. As the maximum pulse heating capacity of the step heating elements 24 for the MP pulses of heating cycle C is generally equal to the total step heating capacity of all N step heating elements, activating the pulse heating elements for PP pulses relative the MP maximum amount of pulses, where PP relative to MP is generally proportional to the required quantity R of step heating elements 34 compared to the total quantity N of step heating elements 34, generates a required pulse amount of heat with the pulse heating element 24 that is generally equal to the required amount of heat that would be generated for the heating cycle by the R step heating elements 34.

Figure 3:
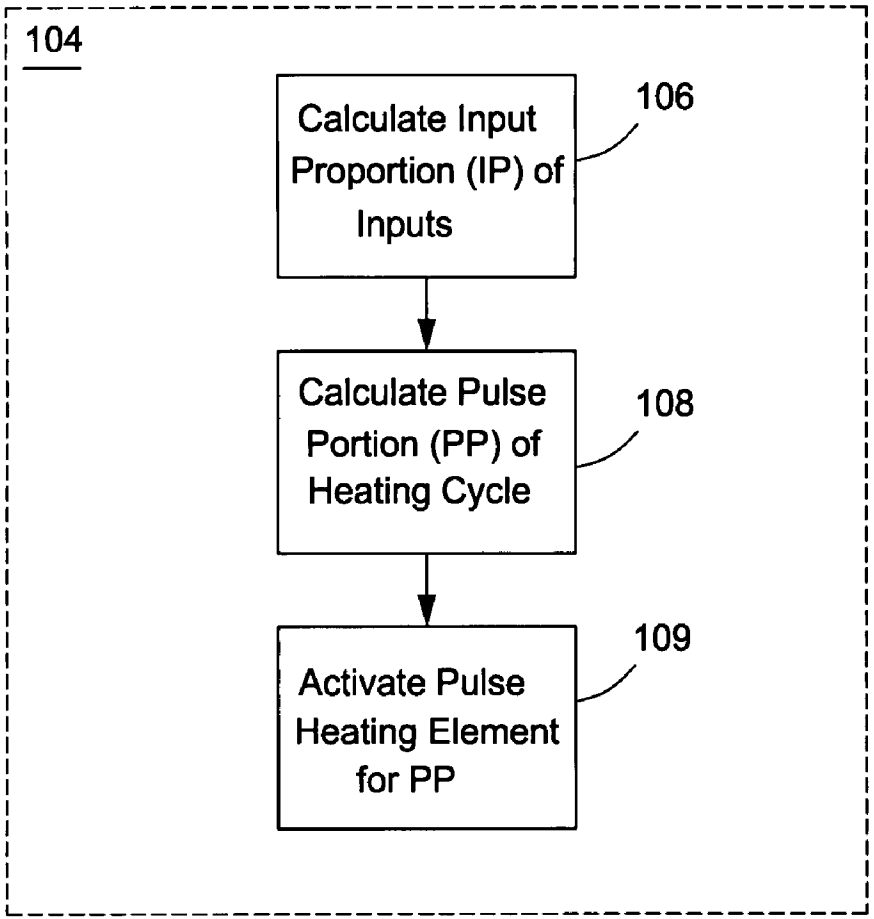
FIG. 3 is a flow chart showing a step of activating the pulse heating element for the method of FIG. 2.

Referring is now more particularly made to FIGS. 2, 3, 4, and 4*a*. As shown in FIG. 3, the step 104 of activating the pulse heating element 24 includes, after the step 102 of detecting the respective signals for the mechanical relays 32, determining, i.e. calculating, at step 106 an input proportion IP of the respective inputs 16 that have received respective signals to activate the corresponding mechanical relays 32 relative to the total quantity N of the inputs 16. The input proportion IP, calculated preferably by the pulse modulator 20 of pulse heating controller 14, is the proportion or ratio of the number of inputs 16 having received the signals for activating the mechanical relays 32, equal to the required quantity R of step heating relays 32 and step heating elements 34, to the total quantity N of inputs 16. Next, at step 108, the pulse heating controller 14 calculates the pulse portion PP as the proportional quantity of pulses of pulse heating element 24 for the predefined period of time T of the heating cycle C relative to a maximum quantity of pulses MP of the pulse heating element for the predefined period of time for the predefined heating cycle by calculating the input proportion IP of the maximum quantity of pulses MP. Then, at step 109, the pulse modulator 20 activates the solid state relay 22, and thereby the pulse heating element 24, for the proportional quantity PP of pulses for the predefined period of time T of the heating cycle C.

Figure 4:
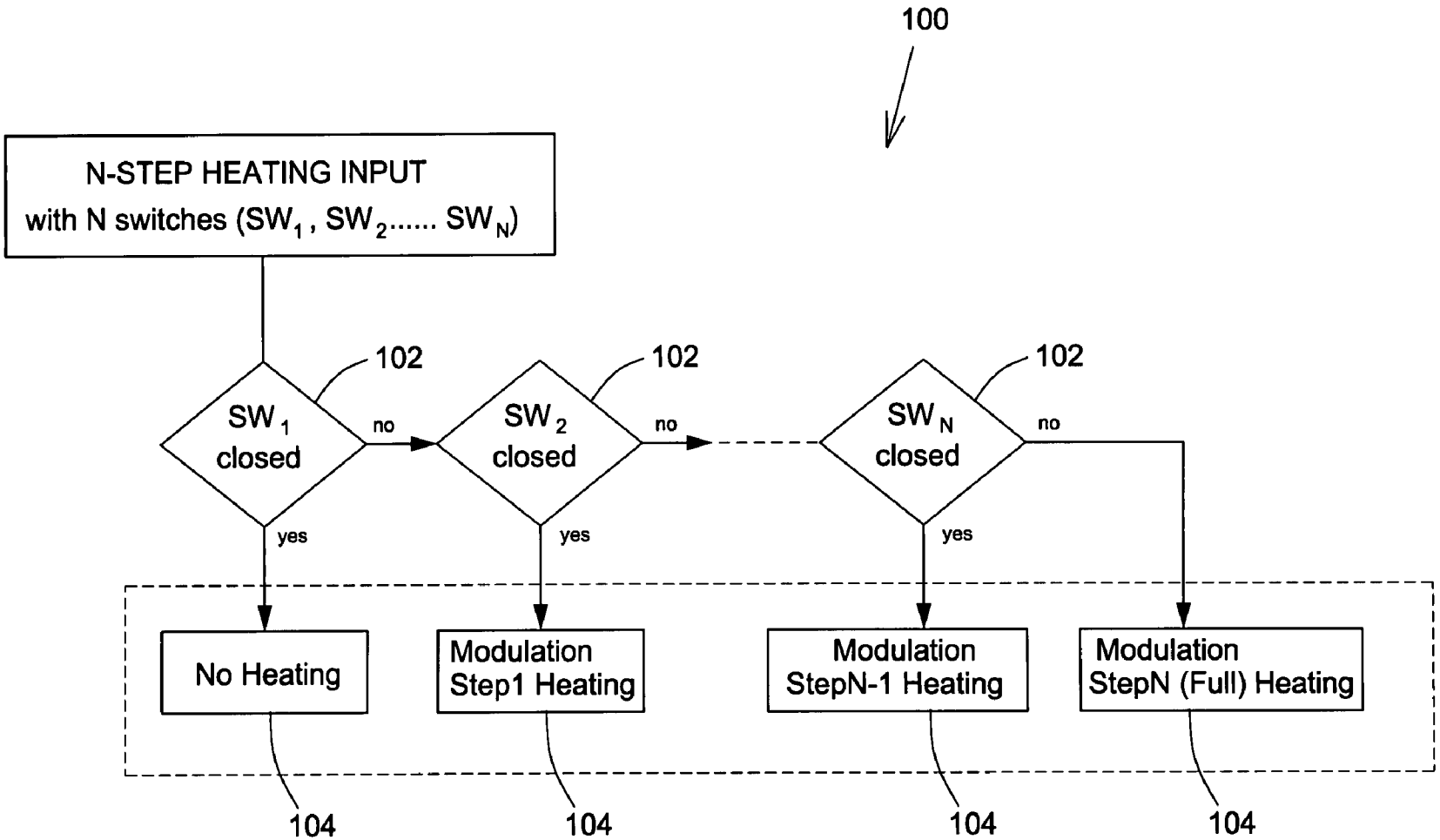
FIG. 4 is a flow chart showing a step of calculating a proportional quantity of pulses for increasing heat generation for the method shown in FIG. 2.
Figure 4A:
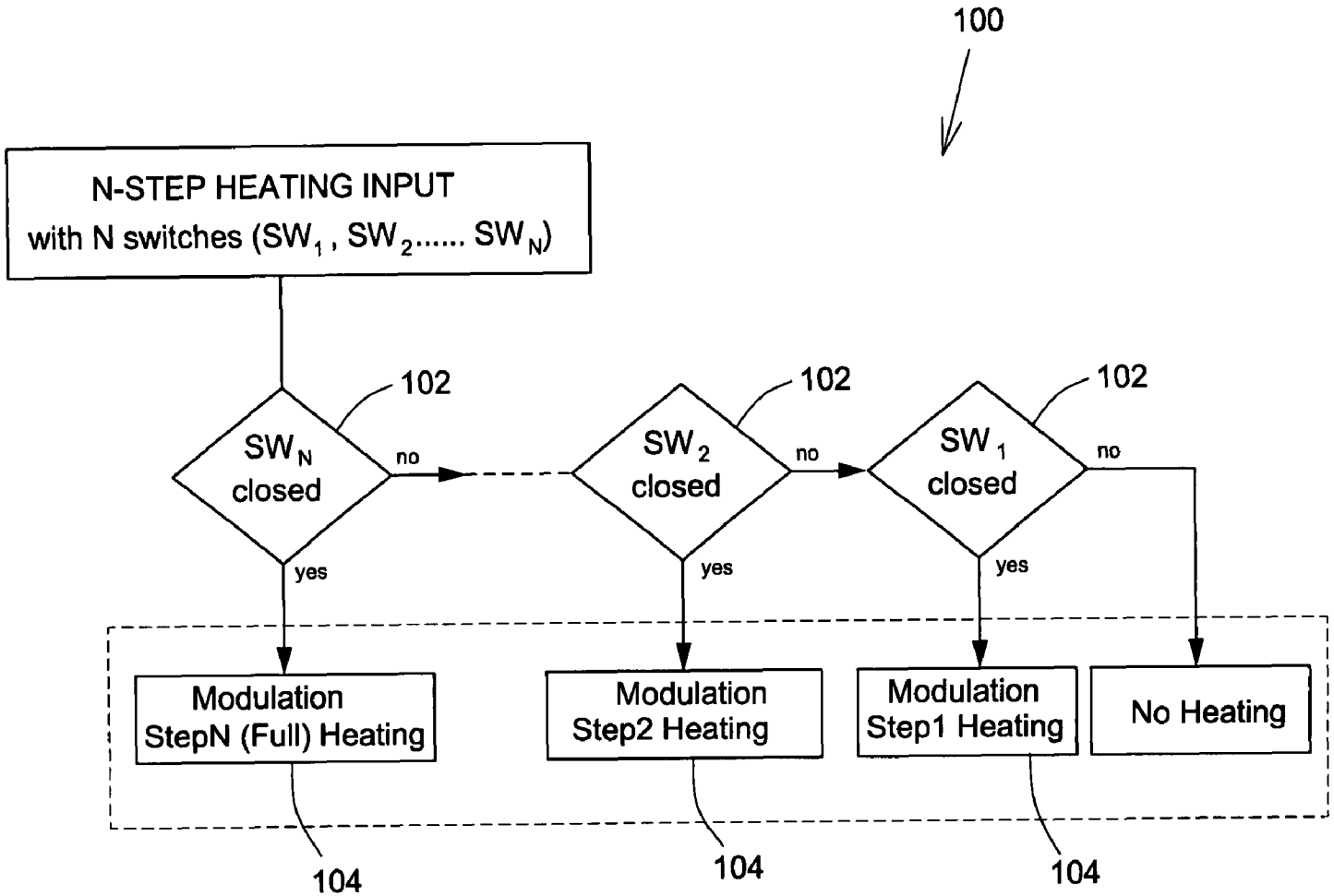
FIG. 4*a* is a flow chart showing a step of calculating a proportional quantity of pulses for increasing heat generation for the method shown in FIG. 2.

The predefined sequence in which the respective signals for the inputs 16, and thereby the mechanical relays 32 and step heating elements 34, are received at step 102 is illustrated in further detail in FIGS. 4 and 4*a*. As shown in step 102 of FIG. 4, for each corresponding step heating input 16, the pulse heating controller 14, and more specifically the pulse modulator 20 detects, preferably at the beginning or at the end of each heating cycle C, which corresponding inputs 16 have signals indicating that the corresponding mechanical relays 32 should be activated and deactivated. Typically, step 102 is effected by counting the respective inputs 16 having signals indicating that the corresponding mechanical relays 32 should be activated and/or deactivated, number of inputs 16 having activation signals corresponding to the required quantity R of inputs 16. For example, if there are N corresponding inputs 16, connected to the main controller 12 and the pulse heating controller 14, the pulse heating controller 14, solid state relay 22, and pulse heating elements 24 thus replace N step heating relays 32 and N traditional step heating elements 34, with R required respective inputs 16 possibly receiving activation signals corresponding to 0 through R required step heating relays 32 and step heating elements 34 being activated to generate a required amount of heat, where R extends between 0 and N. If there is an activation signal on respective inputs 16 (0 through R), then the controller 14 interprets the signals as indicating that step heating relays 32 (0 through R) and step heating elements 34 (0 through R), now replaced by the single solid state relay 22 and the pulse heating element 24, are to be activated. Alternatively, as step heating elements 34 in step heating systems are sequentially activated in ascending order, the pulse heating controller 14 can simply detect the respective input 16 (0 through N) having an activation signal that is most advanced in the sequence, i.e. the last or highest input 16 (R) to receive an activation signal. Any input 16 from 0 through R is thus determined by the pulse heating controller 14 to have received a signal for activation and any input 16 from R+1 to N is presumed to not have received an activation signal or to have received a deactivation signal.

As shown for step 102 in FIG. 4*a*, the pulse modulator 20 controller interprets signals received from the main heating controller 12 by inputs 16 for deactivating mechanical relays 32 and step heating elements 34 in declining or reverse order of the predefined sequence. That is, if there is a is a deactivation signal received on respective inputs 16 (R through N), then the controller 14 interprets the signals as indicating that corresponding step heating relays 32 (R through N) and step heating elements 34 (R through N), now replaced by the single solid state relay 22 and the pulse heating element 24, are to be deactivated. Alternatively, as step heating elements 34 in step heating systems are sequentially deactivated in descending order, the pulse heating controller 14 can simply detect the respective input 16 (0 through N) having a deactivation signal that is least advanced in the sequence, i.e. the lowest or first input 16 (R) receiving a deactivation signal. Any input 16 from R through N is thus determined by the pulse heating controller 14 to have received a signal for deactivation and any input 16 from 0 to R−1 is presumed to have received an activation signal.

The calculation of the pulse portion PP of pulses of solid state relay 22 and pulse heating element 24 at step 104 is also illustrated in further detail by reference to FIG. 3 in conjunction with in FIGS. 4 and 4*a*. As stated previously, based on the input quantity R of respective inputs 16 (0 through R, where R is less than or equal to N) that have an activation signal, the pulse heating controller 14 then activates the solid state relay 22, and thereby the pulse heating element 24 for pulse portion PP of pulses of the maximum quantity of pulses MP for the heating cycle C. To calculate the pulse portion PP of pulses, the pulse heating controller 14, and preferably the pulse modulator calculates, at step 106, the input portion IP or ratio of respective inputs R having an activation signal compared to the total number of inputs N by dividing R by N, i.e. IP=R/N. The pulse portion PP of pulses is then calculated at step 108 by calculating the input portion IP of the total maximum possible pulses MP for the predefined period of time T of the heating cycle C, i.e. PP=IP*MP. For example, suppose there are a total of 3 (N) inputs 16, and two inputs (R) have activation signals received thereon, preferably at the beginning or end of a heating cycle C which has a maximum quantity MP of pulses of 60 for a predefined period of time T of 1 second. Accordingly, during the heating cycle C, IP=⅔ and the pulse heating controller 14 will activate the solid state relay 22 and heating unit 24 for PP=⅔*60, i.e. 40 pulses over the heating cycle C of 1 second in duration, corresponding to activation of the first two step heating elements 34 out of three such elements 34 in a step heating system. Accordingly, the pulse portion PP relative to the maximum quantity MP is generally proportionally equal to the required quantity R of N step heating elements 34 activated to generate the required amount of heat based on the heat detected by sensor. Therefore, the pulse amount of heat generated by pulse heating elements 24 is generally equal to the required amount of heat that would be generated by the required quantity R of step heating elements 34 for heating cycle C.

When the main heating controller 12 detects, via the heat sensor 18, that heating from one or more of the step heating elements 34 is not required, it sends a deactivation signal, which may consist of simply ceasing to send an activation signal, for the corresponding mechanical step heating relay 32, which is detected by the pulse heating controller 12 via the respective inputs 16 therefor. In such case, the value of R, and therefore PP, is reduced for the heating cycle C. By increasing and decreasing the value of IP, i.e. R/N, and therefore PP, the system 10 provides, based on a step heating input at inputs 16, a pulse modulating heating output, i.e. activation of the solid state relay 22 and pulse heating element 24 system for PP=R/N*T pulses for each predefined period of time T for each heating cycle.

Figure 5:
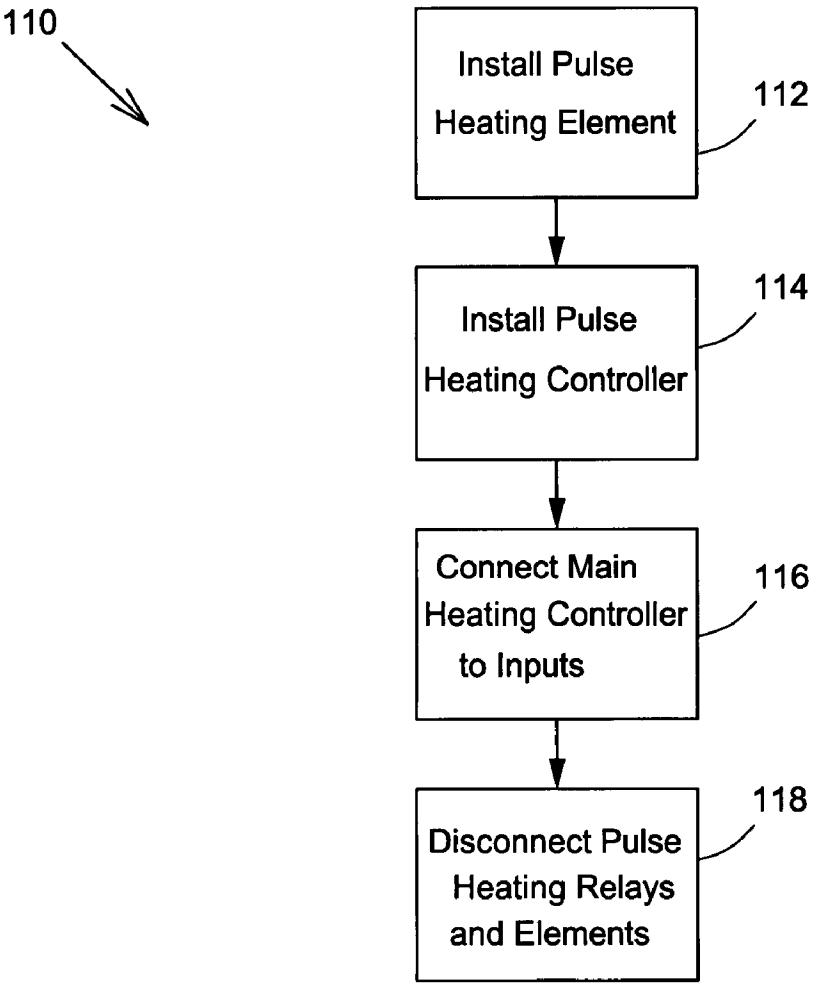
FIG. 5 is a flow chart showing a method for retrofitting connection of the pulse modulating system shown in FIG. 1 to a main heating controller of a step heating system.

Referring now to FIG. 5, therein is shown a method 110 for retrofitting connection of the pulse heating controller 14 and heating element 24 to the main heating controller 12 to replace step heating elements 34 and mechanical step heating relays 32. As shown, the system 10 is installed, i.e. connected, to pulse heating controller by installing the pulse heating unit 24, destined to replace the N step heating elements 34 and mechanical relays 32 for the heating space, at step 112. At step 114, the step heating controller 14 is installed and the pulse heating element 24 is connected to the solid state relay 22 of the pulse heating controller 14. At step 116, the pulse heating controller 14 is connected to the main heating controller 12 by connecting, for each step heating element 34 and respective step heating relay 32 to be replaced, the connection from the main system controller 12 and/or step heating controller to the step heating relay 32, to a respective input 16 on the pulse heating controller 14. The system 10 is then ready for use. Optionally, the step heating elements 34 and step heating relays 32 may be disconnected and/or removed at step 118 as the pulse modulating heating system 10 is installed and connected to the pulse heating controller 14 for each heated space, either during or after installation. Alternatively, if desired and space permitting, the step heating elements 34 and step heating relays 32 may be left in place. Accordingly, the system 10 can be retrofitted, i.e. connected, to a step heating system 10, notably a main heating controller 12 therefor, one discrete heated space of the building at a time, to gradually replace the step heating elements 34 and mechanical relays 32 with pulse modulating controllers 14, solid state relays 22 and pulse heating elements 24.

It should be noted that the required quantity 16 of inputs may be determined, for example counted, and the pulse portion PP calculated at either the beginning or the end of the heating cycle C. For example, the pulse heating controller 14 may count the quantity R of inputs having activation signals at the beginning of each heating, calculate the pulse portion PP and then activate the step heating controller 24 for the pulse portion PP of pulses for the cycle. Alternatively, for each heating cycle C, the pulse heating controller 14 may count the quantity R of inputs having activation signals at the end of the immediately preceding heating cycle, calculate the pulse portion PP, and then activate the step heating controller 24 for the pulse portion PP of pulses for the new, i.e. next cycle.

The heating cycle C may be any period of time T corresponding to any maximum quantity MP of pulses, provided that activation of the pulse heating element 24 for the maximum quantity MP of the period of time T for the heating cycle corresponds to provision of the same amount of heat as activation for the period of time T of all step heating elements 34 replaced by the pulse heating element 24. Further, the solid state relay 22, and pulse heating element 24, may be activated based directly on the input proportion IP of activation signals R to the total number N of inputs 16 connecting the pulse heating controller 14 to the main system controller 12. For example, if there is an activation signal received on one of the inputs 16, thus R=1, and a total of three inputs 16 connected to the main heating controller 12, thus N=3, then IP=⅓ and the controller 14 could simply activate the relay 22 and pulse heating element 24 for one out of every three pulses during the predefined period of time T for the heating cycle C. Alternatively, the pulse controller 14 could calculate the pulse proportion PP as described above, PP=R/N*MP and then simply activate the relay 22 and element 24 for any PP pulses of the next cycle, for example the first PP pulses of period T. In such case, for example, where MP is 120 pulses, and two out of three inputs 16 have activation signals, corresponding to a value of 80 for PP, then the relay 22 and pulse heating element 24 could simply be activated for the first 80 pulses of period T. The pulse heating controller 14 rounds any values calculated for PP to the nearest integer.

Alternatively, if desired, C may be simply defined as a predefined period of time T, without a maximum quantity MP of pulses. However, in such case, the heating capacity of the pulse heating element 24 must be such that when the pulse heating element 24 is activated by the entire period T, the pulse heating element generates the same amount as would all of the step heating elements 34 together when activated for the period T. Provided this condition is met, then PP is simply calculated as the input portion IP of the period T for which the pulse heating element 24 is activated, i.e. PP=R/N*T. It should also be noted that the main heating controller 12 may be connected to inputs 16 by any means by which the respective signals for the step heating relays 32 can be transmitted to the inputs. For example, the main heating controller 12 may be connected to inputs 16 by wires or by wireless transmitters and receivers.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A pulse modulation heating system for connection to a main heating controller for an existing step heating system for a discrete space in a building, the step heating system having a heat sensor for detecting a level of heat in the space, a plurality of step heating elements, and a plurality of corresponding mechanical relays, one said corresponding mechanical relay connected to each step heating element, the main heating controller being connected to the heat sensor and configured for connection to the corresponding mechanical relays for, based on the level of heat, providing to the corresponding mechanical relays in a predefined sequence respective signals for each corresponding relay for activating and deactivating the corresponding mechanical relays in the predefined sequence until a required quantity of the corresponding mechanical relays and the heating elements is activated to generate a required amount of heat, the system comprising:

a pulse heating element, said pulse heating element having a total pulse heating capacity when activated over a predefined heating cycle generally equal to a total step heating capacity of all of the step heating elements when activated over said predefined heating cycle; and a pulse heating controller connected to said pulse heating element and having inputs connectable to said main heating controller, one respective input of said inputs for each corresponding mechanical relay for receiving said respective signals instead of the corresponding mechanical relay and for activating said pulse heating element, based on said respective signals, for a pulse portion of said predefined heating cycle, said pulse portion corresponding generally proportionally to the required quantity of the respective inputs receiving said respective signals for activating the corresponding mechanical relays and connected pulse heating elements relative a total quantity of the respective inputs connected to the main heating controller, to generate a pulse amount of heat generally equal to the required amount of heat.

2. The pulse modulating heating system of claim 1, wherein said pulse heating controller comprises a solid state relay connecting said pulse heating controller to said pulse heating element, said pulse heating controller activating said solid state relay during said pulse portion to activate said pulse heating element for said pulse portion.

3. The pulse modulating system of claim 2, wherein said predefined heating cycle is a maximum quantity of pulses for a predefined period of time and said pulse portion is a proportional quantity of pulses for said predefined period of time relative to said maximum quantity.

4. The pulse modulating system of claim 3, wherein said pulse heating controller comprises a pulse modulator connected to said respective inputs and to said solid state relay, said pulse heating modulator activating said solid state relay for said proportional quantity of pulses for said predefined period of time during said heating cycle.

5. The pulse modulating system of claim 3, wherein said pulse heating controller detects said respective inputs receiving said respective signals for activating the corresponding relays signals and calculates said proportional quantity by calculating an input proportion of said respective inputs receiving said respective signals to activate the corresponding relays relative to the total quantity of said inputs and subsequently calculating said proportional quantity as said input proportion of said maximum quantity.

6. The pulse modulating system of claim 5, wherein said pulse heating controller detects said respective signals at a beginning of each said predefined period of time.

7. The pulse modulating heating system of claim 2, wherein said solid state relay is a zero-crossing relay in which the solid state relay is actuable, for activating said pulse heating element, and deactuable, thereby deactivating said pulse heating element, when an alternating current signal received by said zero-crossing relay from said pulse heating controller is generally at 0 volts.

8. The pulse modulating system of claim 7, wherein said alternating current signal is 60 Hz.

9. The pulse modulating system of claim 1, wherein said pulse heating controller determines the required quantity for calculating said pulse portion for said predefined heating cycle by counting, at an end of a preceding said predefined heating cycle, said respective inputs receiving said respective signals for activating said corresponding relays at said end of said preceding said defined heating cycle.

10. The pulse modulating system of claim 1, wherein said pulse heating controller determines the required quantity for calculating said pulse portion for a said predefined heating cycle at a beginning of said predefined heating cycle, by counting said respective inputs receiving said respective signals for activating said corresponding relays at said beginning of said predefined heating cycle.

11. The pulse modulating heating system of claim 1, wherein said predefined heating cycle is a predefined period of time.

12. A method for operating a pulse modulation heating system from a main heating controller for an existing step heating system for a discrete space in a building, the step heating system having a heat sensor for detecting a level of heat in the space, a plurality of step heating elements, and a plurality of corresponding mechanical relays, one said corresponding mechanical relay connected to each step heating element, the main heating controller being connected to the heat sensor and configured for connection to the corresponding mechanical relays for, based on the level of heat, providing to the corresponding mechanical relays in a predefined sequence respective signals for each corresponding relay for activating and deactivating the corresponding mechanical relays in the predefined sequence until a required quantity of the corresponding mechanical relays and the heating elements is activated to generate a required amount of heat, the method comprising the steps of:

receiving the respective signals on respective inputs of a pulse heating controller, one said respective input receiving the respective signals for each corresponding mechanical relay; and activating a pulse heating element with said pulse heating controller, based on said respective signals received by said respective inputs, for a pulse portion of a predefined heating cycle, said pulse heating element having a total pulse heating capacity when activated over an predefined heating cycle generally equal to a total step heating capacity of all of the step heating elements when activated over said predefined heating cycle, said pulse portion of said predefined heating cycle corresponding generally proportionally to the required quantity of the respective inputs receiving said respective signals for activating the corresponding relays relative to a total quantity of the respective inputs connected to the main heating controller, said pulse heating element thereby generating a pulse amount of heat generally equal to the required amount of heat.

13. The method of claim 12, wherein said step of activating a pulse heating element comprises the steps of:

after said receiving the respective signals, calculating an input proportion of said respective inputs receiving said respective signals to activate the corresponding relays relative to the total quantity of said inputs, calculating said pulse portion as a proportional quantity of pulses of said pulse heating element for a predefined period of time for said predefined heating cycle relative to a maximum quantity of pulses of said pulse heating element for said predefined period of time by calculating said input proportion of said maximum quantity; and activating said pulse heating element for said proportional quantity of pulses during said predefined period of time.

14. The method of claim 12, wherein said step of receiving the respective signals comprises the step of counting at a beginning of said predefined heating cycle, said respective inputs receiving said respective signals for activating said corresponding relays at said beginning of said predefined heating cycle.

15. The method of claim 12, wherein said step of receiving the respective signals comprises the step of counting at an end of a preceding said predefined heating cycle, said respective inputs receiving said respective signals for activating said corresponding relays at said end of said preceding said predefined heating cycle.

16. A method for retrofitting connection of a pulse modulation heating system to a main heating controller for an existing step heating system for a discrete space in a building, the step heating system having a heat sensor for detecting a level of heat in the space, a plurality of step heating elements, and a plurality of corresponding mechanical relays, one said corresponding mechanical relay connected to each step heating element, the main heating controller being connected to the heat sensor and configured for connection to the corresponding mechanical relays for, based on the level of heat, providing to the corresponding mechanical relays, in a predefined sequence, respective signals for each corresponding relay for activating and deactivating the corresponding mechanical relays in the predefined sequence until a required quantity of the corresponding mechanical relays and the heating elements is activated to generate a required amount of heat, the method comprising the steps of:

installing a pulse heating element for the heated space, said pulse heating element having a total pulse heating capacity when activated over an predefined heating cycle generally equal to a total step heating capacity of all of the step heating elements when activated over said predefined heating cycle;

installing a pulse heating controller and connecting the pulse heating controller to the pulse heating element; and connecting the main heating controller to inputs for the corresponding mechanical relays on said pulse heating controller, one respective input for each corresponding mechanical relay, for receiving the respective signals for the corresponding mechanical relay, wherein said pulse heating controller is configured for, based on said respective signals, activating said pulse heating controller for a pulse portion of said predefined heating cycle, said pulse portion corresponding generally proportionally to the required quantity of the respective inputs receiving said respective signals for activating the corresponding relays relative a total quantity of the respective inputs previously connected to the main heating controller, to generate a pulse amount of heat generally equal to the required amount of heat.

17. The method of claim 16, further comprising the step of disconnecting the step heating elements and step heating relays.

* * * * *